United States Patent [19]

Swartley

[11] Patent Number: 5,056,674

[45] Date of Patent: Oct. 15, 1991

[54] LIQUID CONTAINER

[76] Inventor: Larry Swartley, 5 Silver City Rd., Newtown, Conn. 06470

[21] Appl. No.: 529,713

[22] Filed: May 30, 1990

Related U.S. Application Data

[63] Continuation of Ser. No. 271,606, Nov. 15, 1988, abandoned.

[51] Int. Cl.[5] ..... B65D 1/02; B65D 1/46

[52] U.S. Cl. ..... 215/31; 215/1 R

[58] Field of Search ..... 215/1 C, 1 R, 31, 32

[56] References Cited

U.S. PATENT DOCUMENTS

| | | | |
|---|---|---|---|
| 18,714 | 11/1888 | Atterbury | 215/1 R |
| 59,687 | 11/1866 | Waldstein et al. | 215/1 R |
| 77,008 | 4/1868 | DeForrest | 215/31 |
| 299,318 | 5/1884 | Atterbury | 215/1 R |
| 633,593 | 9/1899 | Houston | 215/1 R |
| 1,499,612 | 7/1924 | Hammer | 215/1 R |
| 1,647,175 | 11/1927 | Grunberg | 215/1 R |
| 1,648,029 | 11/1927 | Rhodes | 215/1 R |
| 1,930,162 | 10/1933 | Eckard | 215/31 X |
| 2,177,396 | 10/1939 | Watson | 215/31 |
| 2,772,704 | 12/1956 | McConnell et al. | 215/1 R |
| 2,876,818 | 3/1959 | Raff et al. | 215/1 C |
| 3,013,686 | 12/1961 | Blunt | 215/31 |
| 3,591,031 | 7/1971 | Komendowski | 215/1 C X |
| 3,774,795 | 11/1973 | Leenaards | 215/31 X |
| 3,859,117 | 1/1975 | Erchak et al. | 215/1 C X |
| 4,288,478 | 9/1981 | Kinoshita et al. | 215/1 C X |
| 4,301,933 | 11/1981 | Yoshino | 215/1 C |
| 4,352,435 | 10/1982 | Yoshino et al. | 215/1 C |
| 4,421,804 | 12/1983 | Mori et al. | 215/1 C |
| 4,566,600 | 1/1986 | Chang | 215/1 C |
| 4,609,418 | 9/1986 | Yoshino et al. | 156/87 |
| 4,658,974 | 4/1987 | Fujita et al. | 215/1 C X |
| 4,661,188 | 4/1987 | Fumei | 156/244.11 |
| 4,715,504 | 12/1987 | Chang et al. | 215/1 C |
| 4,813,557 | 3/1989 | Herron et al. | 215/1 C X |

FOREIGN PATENT DOCUMENTS

| | | | |
|---|---|---|---|
| 287914 | 11/1926 | Fed. Rep. of Germany | 215/1 R |
| 63-06555 | 7/1988 | Japan . | |
| 420839 | 12/1934 | United Kingdom | 215/31 |
| 2068886 | 8/1981 | United Kingdom | 215/1 C |

*Primary Examiner*—Sue A. Weaver

[57] ABSTRACT

A liquid container having a threaded neck tapering outwardly to a cylindrical body and base portion and provided with a semi-circular shaped annular ring below the neck at the tapered portion. The outer diameter of the ring is such that it is approximately twice the diameter of the neck and half the diameter of the base.

5 Claims, 2 Drawing Sheets

LIQUID CONTAINER

This application is a continuation of application Ser. No. 271,606, filed Nov. 15, 1988, now abandoned.

BACKGROUND OF THE INVENTION

1. Field of the Invention

The present invention relates to liquid containers, and more particularly, to liquid containers for beverages such as carbonated soft drinks having neck portions adapted for ease in racking, carrying, and protection of the threaded neck through the provision of an annular ridge at neck portion.

Liquid containers for beverages such as soft drinks having an annular ridge or ring at the neck area for ease in carrying are well known in the art. These containers generally have a ridge located just below the threads of the neck portion which extends outwardly of the container. These containers are generally of the blow or injection molded plastic type, whereby the ridge is formed prior to molding, and is very rigid and in some instances sharp to the touch. These ridges generally extend outward a distance that is just greater than the distance that the threads extend outward from the neck. In most cases when a cap is applied the outer diameter of the cap is roughly equal to the outer diameter of the ridge.

2. Discussion of the Prior Art

In the prior art, various containers and bottles having an annular ridge or ring at or near the neck portion are disclosed, whereby the ridges have various shapes and are located at various positions on the container neck. These containers and their associated ridges, however, are subject to several disadvantages which, in many cases, inconvenience the consumer, and in some cases, expose the neck portion and the threads of the neck to damage which may destroy the utility of the container. If the threads are damaged, the cap will not properly seal the container, thereby reducing the life of the liquid inside the container due to loss of pressure, leaking, or reducing the integrity of the container potentially leading to injurious catastrophic loss of the contents.

Yoshino, U.S. Pat. No. 4,301,933, Yoshino, et al., U.S. Pat. No. 4,352,435, and Yoshino, et al., U.S. Pat. No. 4,609,418, each disclose a plastic bottle having a cylindrical body and a threaded neck portion with an annular ridge located just below the threads. The ridge is integrally molded to the bottle, and is angled outwardly from the neck at top and bottom of the ridge, and forms a squared-off outer diameter surface. The outer diameter of the ridges of these prior art bottles are such that they extend just past the outer diameter of cap covering the threads, thereby offering very little protection to the caps and threads in the event these bottles should tip over. Damage to the threads and caps in tip-overs is a distinct disadvantage to the ridges provided with these bottles.

Fumei, U.S. Pat. No. 4,661,188, discloses a bottle or container having a thin annular ridge on the neck below the threads. This ridge tapers out from the neck and tapers back, providing an uncomfortable gripping surface, especially for children or elderly persons. The ridge has a pointed edge, and presents a difficult surface for gripping the bottle to pour the liquid contents.

Chang, U.S. Pat. No. 4,566,600, discloses a bottle or container with an annular ridge which angles downward and then terminates in a lip or edge which surrounds the neck. This ridge suffers several disadvantages. There is no protection offered the threads and cap since the ridge angles away from the threads. In addition, the lip or edge presents an uncomfortable gripping surface for carrying or pouring. Furthermore, the construction of this type of ridge eliminates the use of many display racks for displaying the bottle in a store. This is an important feature in the merchandising of these items, and the lack of an adequate ridge for racking purposes limits the display appeal of such a bottle for the retailer.

The novel container pursuant to the present invention obviates the disadvantages of the prior art and provides an easy to handle and dispense container which protects the neck threads and associated cap and provides excellent display rack compatibility for merchandising the product. The rounded semicircular shape of the annular ridge at the neck portion allows for comfortable gripping to ease the dispensing of the liquid product inside the container, especially for children and the elderly, and the thickness and diameter of the ridge provide excellent protection for the threads and cap at the neck in the event of an inadvertent tip-over. The ridge also allows for the accommodation of a variety of merchandising racks, since the gentle curvature of the rounded edges of ridge is adaptable to various slot openings provided on the racks for supporting and displaying the container.

SUMMARY OF THE INVENTION

The present invention eliminates or substantially ameliorates the disadvantages encountered in the prior art through the provision of a liquid container having a semicircular shaped annular ridge or ring which extends outwardly from the neck portion of the container a distance sufficient to protect the threads and cap of the neck during a tip-over.

An easy to handle and dispense container is provided, the container being constructed of either glass or plastic and having a threaded neck portion which tapers outwardly to form a cylindrical body which terminates at a base portion for standing the bottle upright. An annular ridge or ring is provided below the threads on the tapered portion to protect the threads in the event of a tip-over, and also serves as a comfortable and easy to grip surface which aids in pouring or dispensing the liquid product. The ring has a semi-circular shape and extends outwardly a distance approximately equal to twice the diameter of the neck portion. The length of the ring is such that the semicircular shape eliminates or avoids any sharp edges or surfaces which make gripping the container uncomfortable or irritating, especially for young children or the elderly.

The ring also serves to enhance the use of a display rack, and is shaped to accommodate a variety of display racks, which of course increases the appeal of such a container as a merchandising item for retailers. The ring will support the container in various positions, depending of course on the merchandising rack being employed, and since the ring is provided on the tapered portion and not the neck as in most prior art bottles, it may be hung from a rack or displayed at a tilted angle. The diameter of the ring also serves to protect the sealing cap, and therefore the threads underlying the cap, during display in the rack since the cap is unlikely to strike the bars of the rack, due to the protection afforded by the ring.

Accordingly, it is an object of the present invention to provide a liquid container which includes an annular ring in the neck area of the container which alleviates damage to the sealing cap and underlying threads at the neck of the container.

It is a further object of the invention to provide a liquid container which includes an annular ring about the neck area which eases the pouring or dispensing of the liquid products by providing a comfortable and easy to handle gripping surface at the neck area of the container.

It is still a further object of the invention to provide a liquid container which includes an annular ring about the neck area which is shaped such that it enhances the display feature of the container by being adaptable to accommodate a variety of display racks.

It is yet another object of the present invention to provide liquid container having a tapered portion extending from the cylindrical body of the container to the liquid dispensing opening and having an annular ring about the tapered portion which serves to protect the threaded area at the opening in the event of an inadvertent tip-over.

BRIEF DESCRIPTION OF THE DRAWINGS

The foregoing objects and other features of the invention will become more readily apparent and may be understood by referring to the following detailed description of an illustrative embodiment of the liquid container, taken in conjunction with the accompanying drawings, in which.

DETAILED DESCRIPTION OF THE PREFERRED EMBODIMENTS

Figure 1:
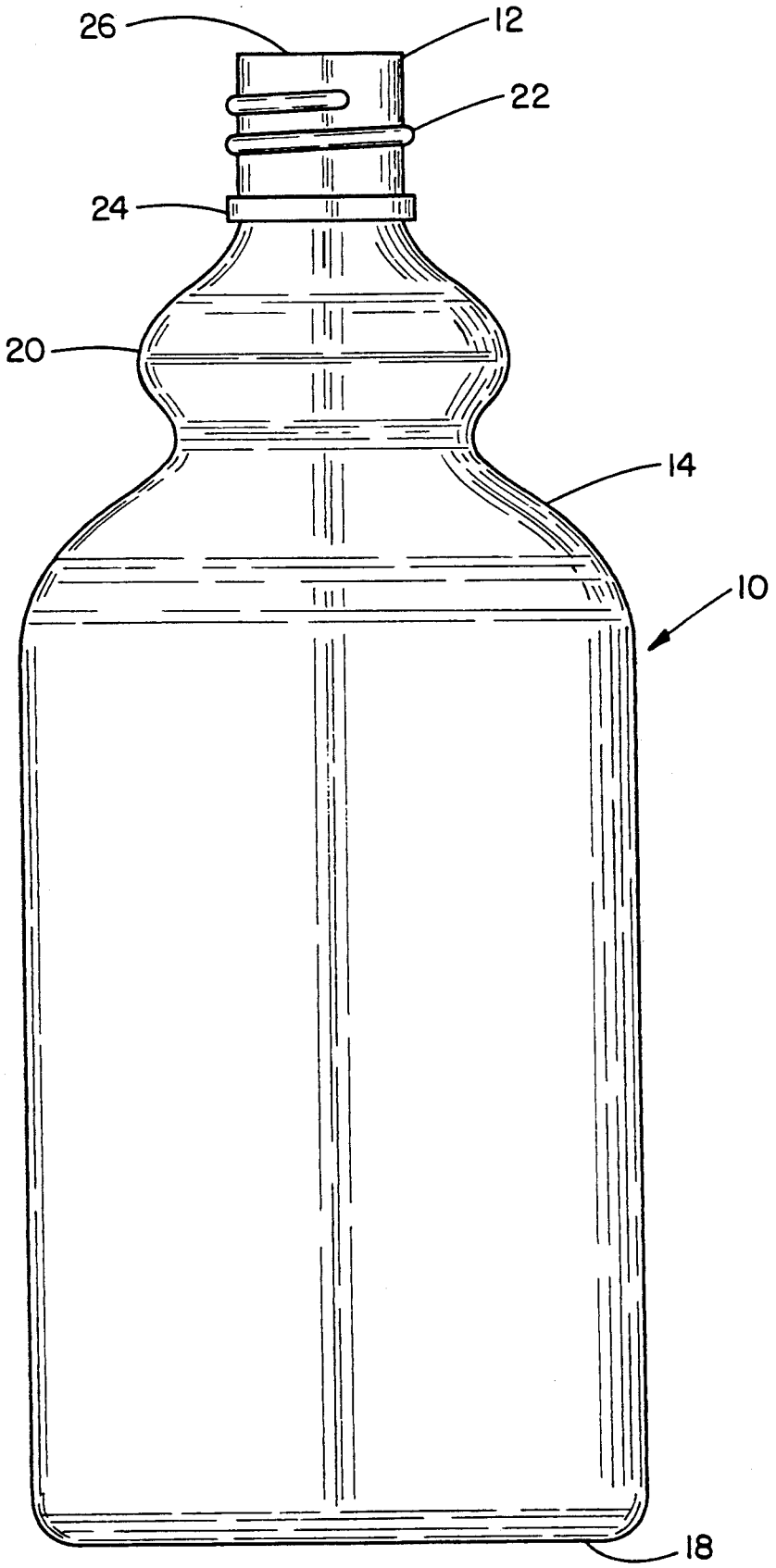
FIG. 1 illustrates a side elevation of the liquid container pursuant to the present invention.

Referring now in specific detail to the drawings, in which identical reference numerals identify similar or identical elements throughout the several views, FIG. 1 shows the preferred embodiment of the liquid container having an annular ring below the neck portion. The liquid container 10 has a neck portion 12 which tapers outwardly in diameter at taper portion 14 to form cylindrical body 16. The shape of the taper portion 14 and body 16 are not critical to the invention; however, it is important that neck portion 12 be cylindrical. Body 16 terminates in a base 18 which closes off the container 10 and permits the container to be able to stand freely.

Neck portion 12 is open at mouth 26 to allow for filling and subsequent dispensing of the liquid product contained in container 10. The neck portion 12 is provided with conventional threads 22 and cap stop 24 for accepting a sealing cap (not shown). However, it is also contemplated that fitted caps may be used, whereby a lip or a single raised edge is provided about neck portion 12 at mouth 26 to accept the fitted cap. Below cap stop 24, in the area where neck portion 12 merges into taper portion 14, there is provided annular ring 20, which is molded as part of container 10 and is an integral part thereof. Container 10 may be glass or any plastic material, but is preferably glass. Ring 20 is formed on container 10 during the blow molding process and obtains its strength and integrity from the thickness it is given during the blow molding process.

Figure 2:
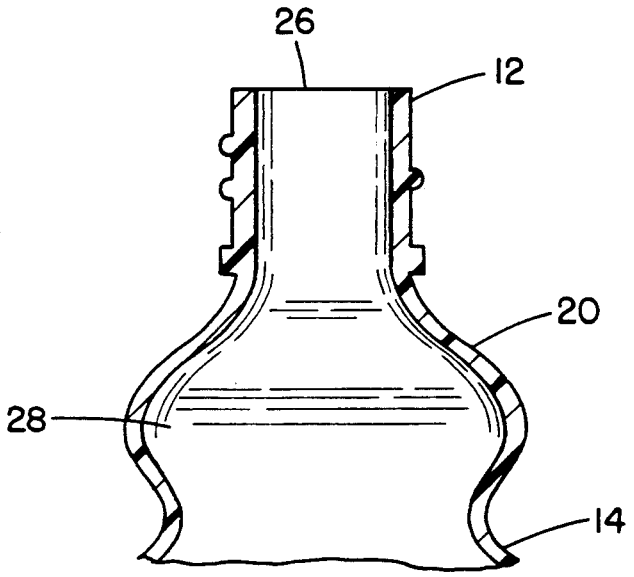
FIG. 2 illustrates an enlarged cut-away side view of the neck portion and tapered portion showing the annular ring according to the preferred embodiment of the present invention.

FIG. 2 shows the neck portion 12 and taper portion 14 in a cut-away view. In a preferred embodiment, ring 20 is molded to have the same wall thickness as the wall thickness of container 10 and forms an internal space 28, which could be used as an accurate fill line. Alternately, when added strength is required, ring 20 can be molded to be solid, as at 30 in FIG. 3.

Ring 20 is formed so as to provide protection for threads 22 on neck 12 in the event of an inadvertent tip-over. Additionally, if a cap is on the container 10 during a tip-over, ring 20 extends outwardly a distance sufficient to protect the cap and ensure a proper seal, which is of paramount importance especially if container 10 is used for carbonated beverages. Accordingly, it is contemplated that ring 20 extend outwardly a distance such that the outer diameter of ring 20 is equal to or greater than twice the outer diameter of neck 12 at mouth 26. This ensures protection for the threads 22, as well as for a cap, during a tip-over since the container 10 will impact on the ring 20 and not on the threads 22. It is also expected that ring 20 have a diameter approximately half as large as the diameter of the base 18.

Figure 3:
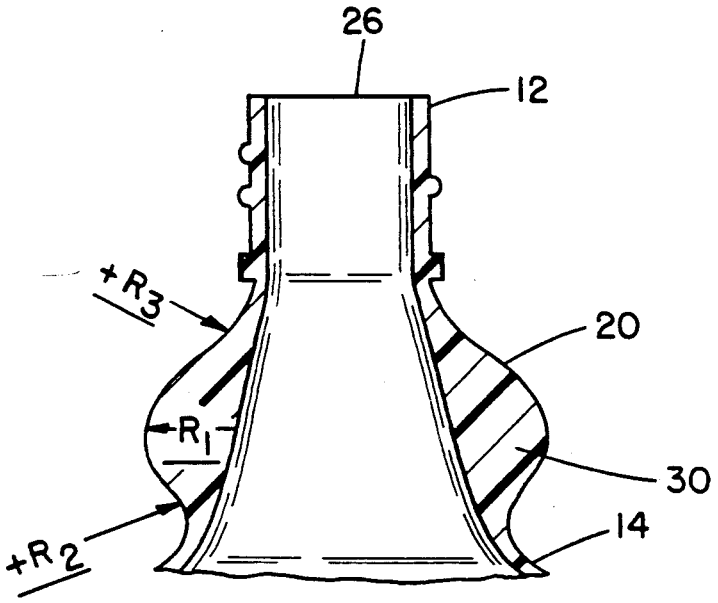
FIG. 3 illustrates an enlarged cut-away side elevation of an alternate embodiment of the annular ring of the neck and tapered portion of the present invention.

A second important consideration in the construction of the ring 20 of container 10, as seen in FIG. 3, is the length of ring 20. The semi-circular shape of ring 20 is such that the radius $R_1$ of the ring 20 as measured from the wall of container 10 is at least 1.3 times the radius of curvature $R_2$ of the location where the ring 20 merges with the taper portion 14 below ring 20. Above the ring 20, at the point where it merges with neck portion 12, the radius of curvature $R_3$ at the merge is approximately 1.5 greater than the radius $R_1$ of the ring 20. This provides several advantages for container 10, the first of which is that it ensures a large length for ring 20, so that an impact with a support surface during tip-over is distributed over a larger area and will lessen the likelihood of damage to the container 10 during tip-over. Secondly, the gentle curves provide a comfortable gripping surface for transporting the container 10. This gripping surface also provides another advantage in that it makes pouring and dispensing much easier, as no sharp edges or lips are encountered. This eases dispensing for young children or elderly persons, by providing a comfortable, non-irritating gripping surface for pouring. Finally, a fourth distinct advantage to such a ring is that the diameter and length of the ring 20 allows for the use of a variety of merchandising racks, since the ring 20 will be accommodated in slots of the various sizes common to these racks.

While the invention has been particularly shown and described with reference to the preferred embodiments, it will be understood by those skilled in the art that various modifications and changes in form and detail may be made therein without departing from the scope and spirit of the invention. Accordingly, modifications such as those suggested above, but not limited thereto, are to be considered within the scope of the invention.

What is claimed is:

1. A liquid container comprising:

a cylindrical neck portion having a dispensing opening at an upper end thereof, a cylindrical container body coaxial with said neck portion and being of a larger diameter than said neck portion; an outwardly extending taper portion extending from the lower end of said neck portion to define a juncture, said taper portion connecting to said body at the opposite end thereof, a base portion at the lower end of said container body, and an integral convex annular ring extending about said taper portion adjoining said juncture of said taper portion with said neck portion, said ring having a semi-circular shape extending outwardly from said taper portion and having an external diameter approximately twice the diameter of said cylindrical neck portion and less than one-half the diameter of said cylindrical container body, whereby the ring will permit the bottle to be used with a variety of merchandising racks.

2. A liquid container as claimed in claim 1, wherein said ring has a wall thickness equal to the wall thickness of said taper portion.

3. A liquid container as claimed in claim 1, wherein said ring is solid.

4. A liquid container as claimed in claim 3, wherein said convex semi-circular ring is integrally formed with said container wall, such that said neck curves outwardly to said ring, said ring further curving inwardly to said taper portion, and wherein said ring has a semi-circular inner radius at least 30% greater than a radius of curvature at the location below said ring where said ring inwardly curves to merge with said taper portion, and further wherein said semi-circular inner radius of said ring is approximately 33% smaller than a radius of curvature at the location above said ring where said neck portion outwardly curves to merge with said ring.

5. A liquid container as claimed in claim 1, wherein said neck portion includes a threaded portion and a sealing ridge.

* * * * *